US012151859B2

(12) United States Patent
Angelozzi et al.

(10) Patent No.: US 12,151,859 B2
(45) Date of Patent: Nov. 26, 2024

(54) CHILD RESISTANT CLOSURE AND SPOUT COMBINATION

(71) Applicant: RIEKE LLC, Auburn, IN (US)

(72) Inventors: Anthony Angelozzi, Fort Wayne, IN (US); Dale W. Taylor, Hamilton, IN (US)

(73) Assignee: RIEKE LLC, Auburn, IN (US)

( * ) Notice: Subject to any disclaimer, the term of this patent is extended or adjusted under 35 U.S.C. 154(b) by 233 days.

(21) Appl. No.: 17/637,945

(22) PCT Filed: Aug. 31, 2020

(86) PCT No.: PCT/US2020/048689
§ 371 (c)(1),
(2) Date: Feb. 24, 2022

(87) PCT Pub. No.: WO2021/042018
PCT Pub. Date: Mar. 4, 2021

(65) Prior Publication Data

US 2022/0281658 A1 Sep. 8, 2022

Related U.S. Application Data

(60) Provisional application No. 62/893,271, filed on Aug. 29, 2019.

(51) Int. Cl.
*B65D 50/04* (2006.01)
*B65D 47/06* (2006.01)
(Continued)

(52) U.S. Cl.
CPC ..... *B65D 50/046* (2013.01); *B65D 47/061* (2013.01); *B65D 47/123* (2013.01);
(Continued)

(58) Field of Classification Search
CPC .... B65D 47/063; B65D 47/103; B65D 5/746; B65D 47/10; B65D 47/128;
(Continued)

(56) References Cited

U.S. PATENT DOCUMENTS 2,661,128 A * 12/1953 Rieke ..... B65D 47/127 292/256.61
3,613,966 A * 10/1971 Summers ..... B65D 47/063 222/529

(Continued)

FOREIGN PATENT DOCUMENTS

DE 9206318 U1 9/1992
EP 0701949 B1 6/1998

OTHER PUBLICATIONS

International Search Report and Written Opinion mailed Nov. 20, 2020; International Patent Application No. PCT/US2020/048689 filed on Aug. 31, 2020.

*Primary Examiner* — Steven A. Reynolds
*Assistant Examiner* — Prince Pal
(74) *Attorney, Agent, or Firm* — McDonald Hopkins LLC

(57) ABSTRACT

A screw-top closure cap having a collapsible spout nesting within a cap and with a portion of the spout seated coaxially within the container neck itself is disclosed. Both the spout and the cap incorporate child-resistant features to prevent unwanted removal of the closure and/or use of the spout.

17 Claims, 12 Drawing Sheets

(51) Int. Cl.
*B65D 47/12* (2006.01)
*B65D 51/18* (2006.01)

(52) U.S. Cl.
CPC ..... *B65D 51/18* (2013.01); *B65D 2215/02* (2013.01); *B65D 2251/0025* (2013.01); *B65D 2251/0093* (2013.01); *B65D 2251/023* (2013.01); *B65D 2401/15* (2020.05)

(58) Field of Classification Search
CPC .. B65D 2401/15; B65D 25/44; B65D 47/123; B65D 50/046; B65D 47/061; B65D 51/18; B65D 2215/02; B65D 2251/0025; B65D 2251/0093; B65D 2251/023
USPC ..... 222/529, 541.9; 215/213, 216
See application file for complete search history.

(56) References Cited

U.S. PATENT DOCUMENTS 4,413,743 A 11/1983 Summers
4,442,949 A * 4/1984 Dwinell ..... B65D 47/063 222/541.9
4,618,078 A * 10/1986 Hamman ..... B65D 47/103 222/529
4,746,025 A * 5/1988 Krautkramer ..... B29C 66/81433 215/253
5,004,126 A 4/1991 Klesius
5,115,932 A 5/1992 Schneider
5,566,864 A * 10/1996 Stolz ..... B65D 47/063 222/529
5,577,643 A * 11/1996 Stolz ..... B65D 5/746 222/541.9
5,884,815 A * 3/1999 Stolz ..... B65D 47/123 215/217
6,237,818 B1 5/2001 Kline
6,883,689 B2 * 4/2005 Odet ..... B65D 51/20 222/541.9
7,717,307 B2 * 5/2010 Baughman ..... B65D 47/103 222/541.9
7,789,277 B2 * 9/2010 Baughman ..... B65D 47/063 222/541.9
8,292,133 B2 * 10/2012 Baughman ..... B65D 25/44 222/541.9
8,453,889 B2 * 6/2013 Park ..... B65D 47/063 222/541.9
2004/0020943 A1 * 2/2004 Shinozaki ..... B65D 47/123 222/153.07
2010/0264144 A1 * 10/2010 Nusbaum ..... B65D 47/0861 220/258.2
2010/0282783 A1 * 11/2010 Baughman ..... B65D 25/44 222/541.9
2011/0114679 A1 * 5/2011 Park ..... B65D 47/063 222/541.9
2015/0217910 A1 * 8/2015 Vogel ..... B65D 47/40 222/111
2017/0305604 A1 * 10/2017 Sessions ..... B65D 25/44
2018/0319551 A1 * 11/2018 Ferrari ..... B65D 47/242
2020/0198850 A1 * 6/2020 Iniesta ..... B65D 47/043
2020/0317406 A1 * 10/2020 Abraham ..... B65D 41/3409
2022/0250811 A1 * 8/2022 Heinzle ..... B65D 51/1677
2023/0146015 A1 * 5/2023 Serviuc Pavezi ..... B65D 53/02 220/214

* cited by examiner

CHILD RESISTANT CLOSURE AND SPOUT COMBINATION

CROSS REFERENCE TO RELATED APPLICATIONS

This application is a 35 U.S.C. § 371 national stage application of PCT Application No. PCT/US2020/048689 filed on Aug. 31, 2020, entitled "CHILD RESISTANT CLOSURE AND SPOUT COMBINATION," which claims priority to U.S. Provisional patent application No. 62/893,271 filed on Aug. 29, 2019, each of which is incorporated by reference in its entirety herein.

TECHNICAL FIELD

This disclosure relates generally to dispensers and, more specifically, to screw-top closure cap having a collapsible spout nesting within a cap and with a portion of the spout seated coaxially within the container neck itself. Both the spout and the cap incorporate child-resistant features to prevent unwanted removal of the closure and/or use of the spout.

BACKGROUND OF INVENTION

Closures may be secured to the container neck or to a neck opening of the container by various construction techniques, including snap-on constructions, threaded constructions and plug-in constructions, as some examples. In this manner, the closure can be selectively removed so that flowable products carried within the container can be selectively dispensed and used.

Container manufacturers often prefer to deliver additional functionality within such closures. Two of the more common approaches are child-resistant features, which require multiple, coordinated actions to enable removal of the closure from the container, and dispensing features, where by the closure includes structure to facilitate in the dosing and/or directional dispensing of fluid as it exits the container.

U.S. Pat. No. 4,413,743 contemplates a dispenser that integrates a dispensing nozzle with certain child-resistant features provided on the nozzle assembly itself. U.S. Pat. Nos. 3,613,966; 4,618,078; 6,237,818; 7,717,307; 7,789,277; and 8,292,133 disclose various arrangements for a collapsible spout and cap combination. In all instances, these spouts are envisioned as being incorporated into the flat panel of drum or other industrial-sized container, with a periphery of the closure held within or around a flange (usually metallic) formed in the panel. As such, the spouts effectively become a permanent fixture of the container and, therefore, cannot be easily mounted on or removed from the container. Each of these documents is incorporated by reference as if fully rewritten herein.

All of these structures must also be considered within the context of efficient, cost effective manufacturing techniques. Accordingly, manufacturers of containers and closures often prefer to use plastics, via common techniques such as thermoforming, compression or gas-assisted molding, and blow or injection molding. Blow and injection molding techniques are particularly prevalent within the closure and container field, with both involving the introduction of molten resin into a mold cavity (injection molding introduces the molten resin via predetermined entry ports within the cavity, whereas blow molding uses a molten preform placed within the mold cavity, which is then inflated with compressed gas/air in a manner somewhat similar to glassblowing). However, one consideration particularly relevant to blow molding is the creation of "split line" and "pinch-off" points, based upon how the mold engages the preform. These points represent potential areas of structural weakness and, therefore, requires special consideration when integrating features onto a blow-molded part.

While many of the foregoing disclosures provide a convenient and useful way to deliver a spout within a closure, a collapsible spout that can be integrated within a screw-top-style closure is needed. Further, if such a closure and container combination possessed child resistant features, it would be welcome. Lastly, having a child-resistant spout that can be formed by blow molding would be particularly helpful.

SUMMARY OF INVENTION

A collapsible spout is integrated within a screw cap closure, so as to allow for mounting and/or removal of the closure assembly onto a variety of threaded container necks (as opposed to being captured within a flange on the flat panel of a drum). The closure and container possess cooperating, child resistant lugs, with the lugs on the container formed on opposing edges and away from the blow molded split line. The closure includes additional child resistant lugs to selectively restrain a cover cap over the spout opening. In some embodiments, the cover cap may also include tamper-evident, frangible connectors for added product/container security.

The claims below form an express portion of this written disclosure. The use and illustration of specific terms and structures does not necessarily preclude this disclosure from also encompassing other, similar terms and structures, as would be apparent to those working in this field.

DESCRIPTION OF THE DRAWINGS

The drawings referenced below show various embodiments of the invention. Any written matter, as well as dimensions and relative ratios or sizes that can be discerned or calculated from these drawings, is incorporated as written material herein. Also, the components and arrangements individually illustrated in the Figures are drawn to scale so that additional information about the relative size, spacing, arrangement, and attachment of the components can be discerned and, thereby, form an explicit part of this written disclosure.

FIG. 9A is an top perspective view of the closure of FIG. 7 but with the spout omitted, while

DESCRIPTION

The appended claims, drawings, and description all disclose certain elements of the invention. While specific embodiments are identified, it will be understood that elements from one described aspect may be combined with those from a separately identified aspect. In the same manner, a person of ordinary skill will have the requisite understanding of common processes, components, and methods, and this description is intended to encompass and disclose such common aspects even if they are not expressly identified herein.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

Figure 1:
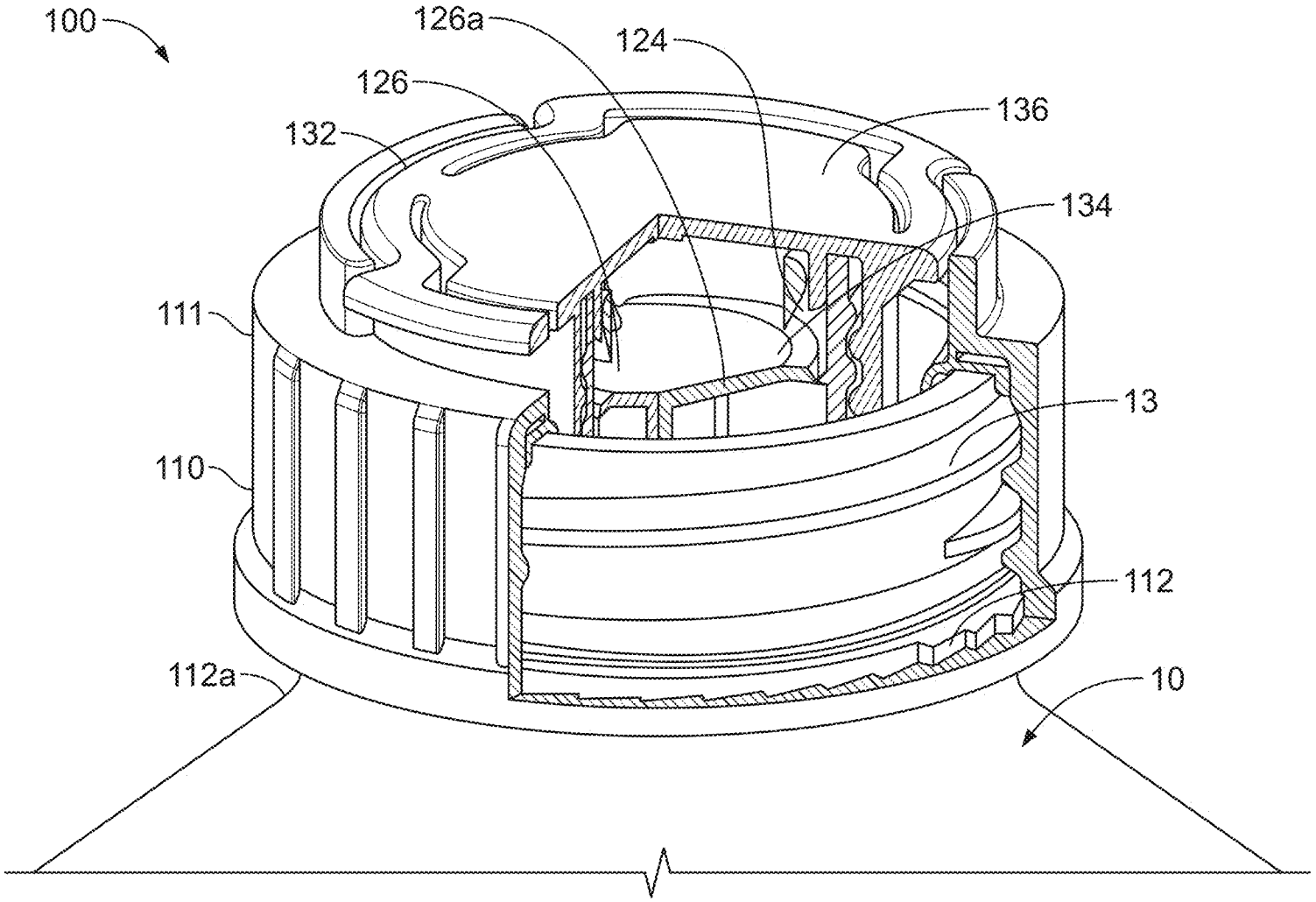
FIG. 1 is a top perspective view of closure, including a cover cap, affixed to a container, but with a sectional cutaway along one quarter of the closure so as to highlight certain internal features and aspects of its attachment to and engagement with the container.
Figure 2:
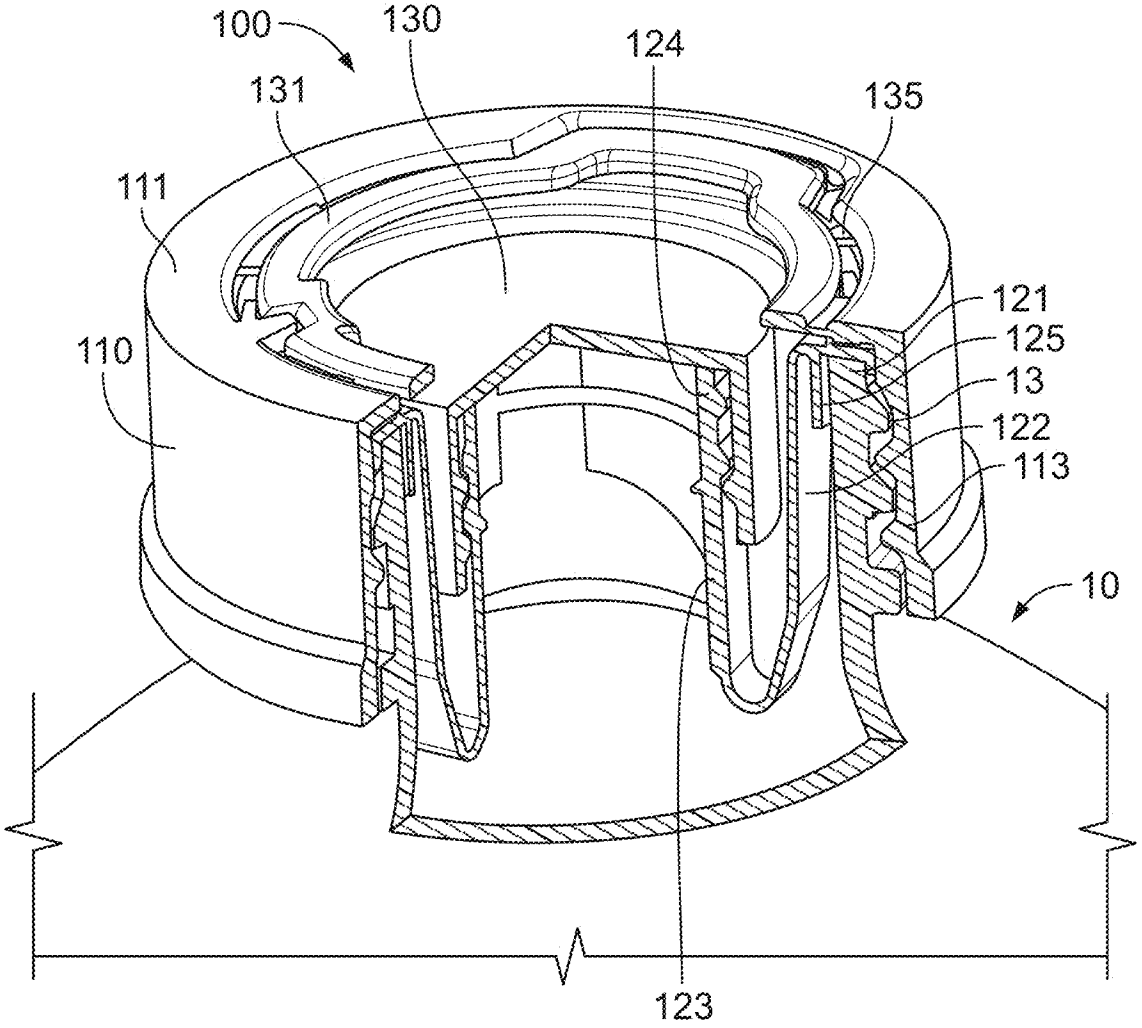
FIG. 2 is a top perspective view of closure, with the cover cap removed, affixed to a container, but with a sectional cutaway along one quarter of the closure and container so as to highlight certain internal features and aspects of its attachment to and engagement with the container.
Figure 3A:
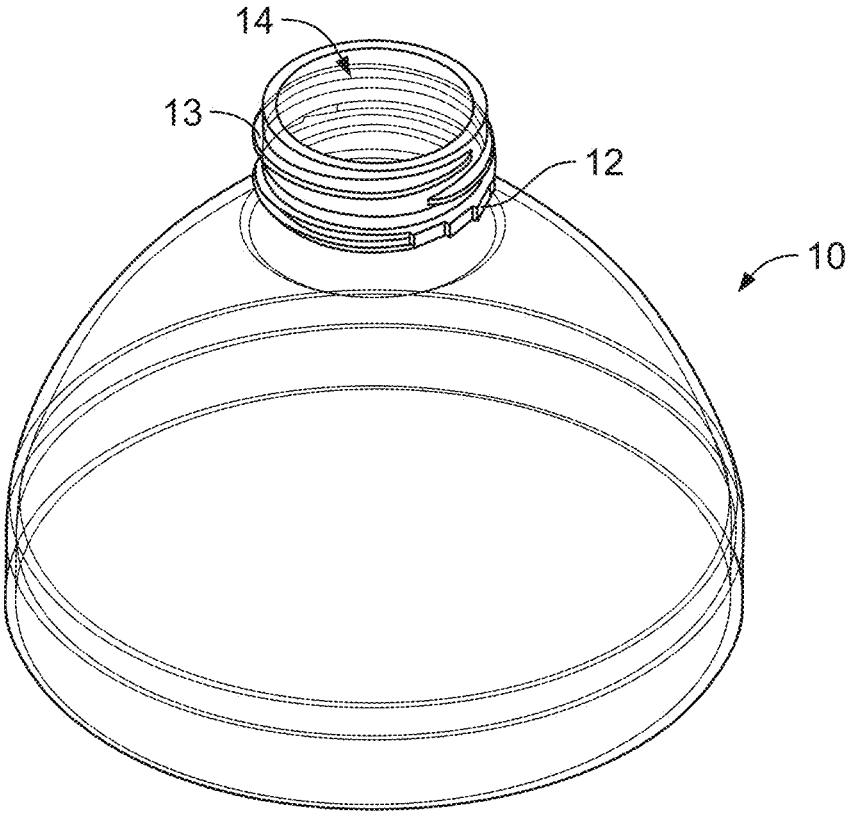
FIG. 3A is a top perspective, sectional view of the top half of the container, including anti-back off lugs integrally formed on both side of and proximate to the blow mold split line.
Figure 3B:
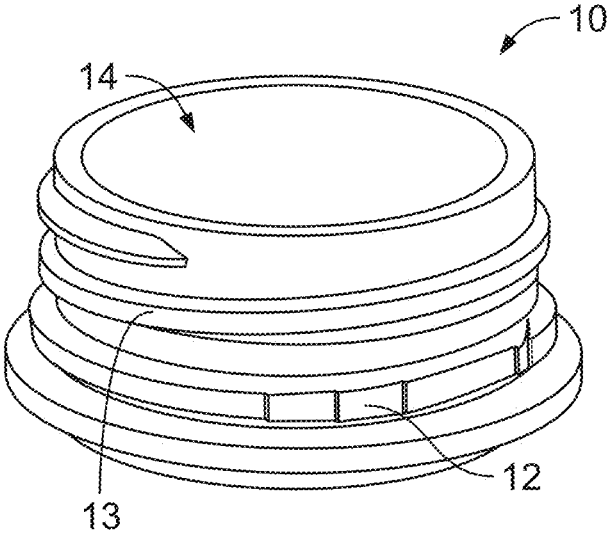
FIG. 3B is an isolated top perspective view of the neck portion of the container depicted in FIG. 3A.
Figure 3C:
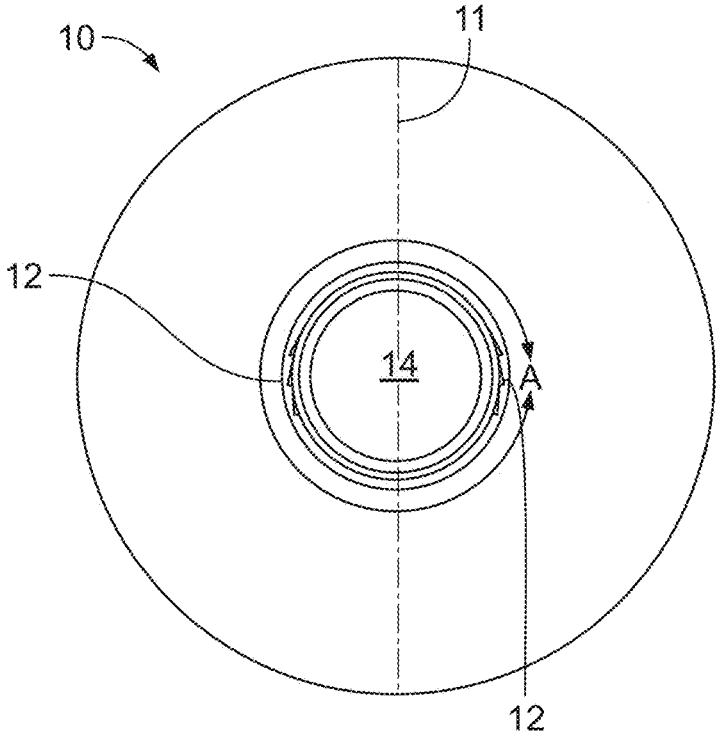
FIG. 3C is a top plan view and FIG. 3D is a side plan view, both showing the container depicted in FIG. 3A.
Figure 3D:
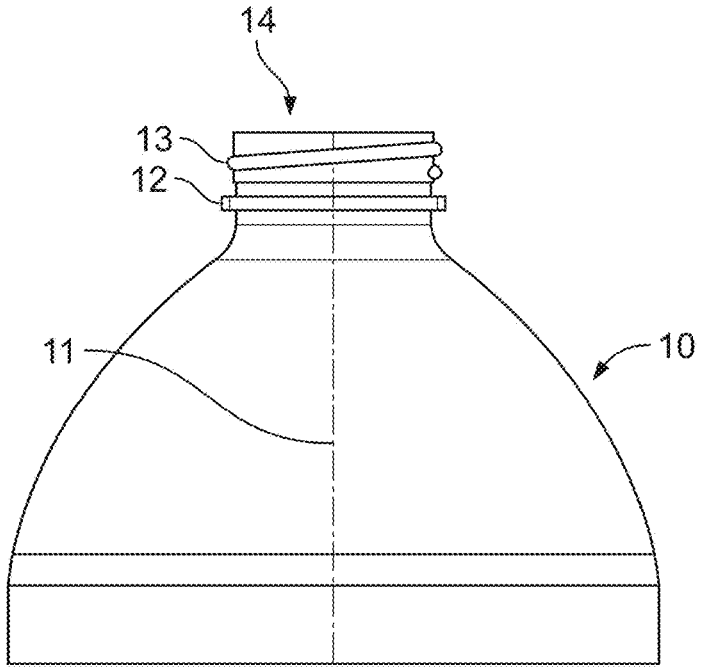
Figure 4:
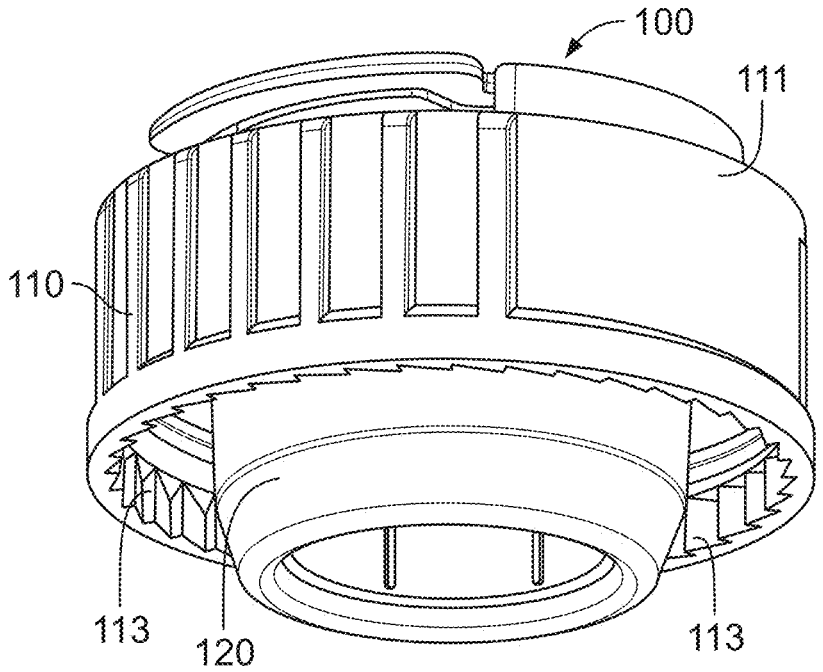
FIG. 4 is a bottom perspective view of closure of FIG. 1 in isolation, highlighting the positioning of the collapsible spout beneath and coaxially within the closure and cover cap.
Figure 5:
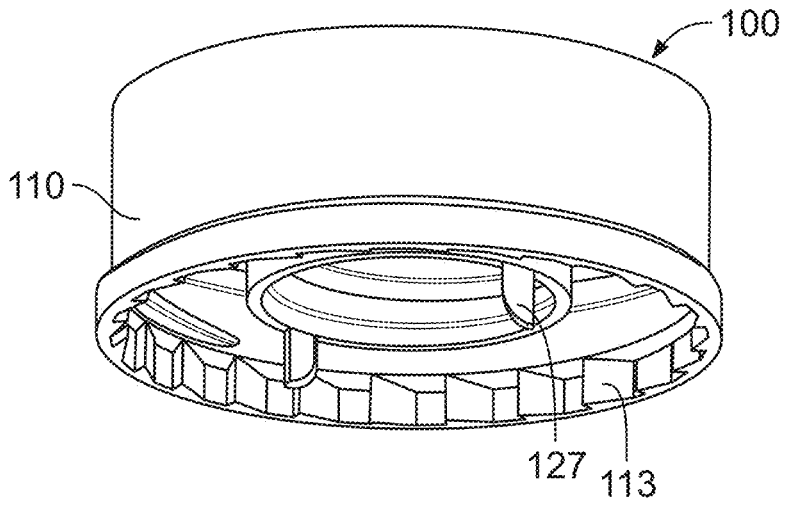
FIG. 5 is bottom perspective, sectional view of the closure of FIG. 4, but with the spout deliberately omitted to highlight the child resistant lugs and tabs.
Figure 6A:
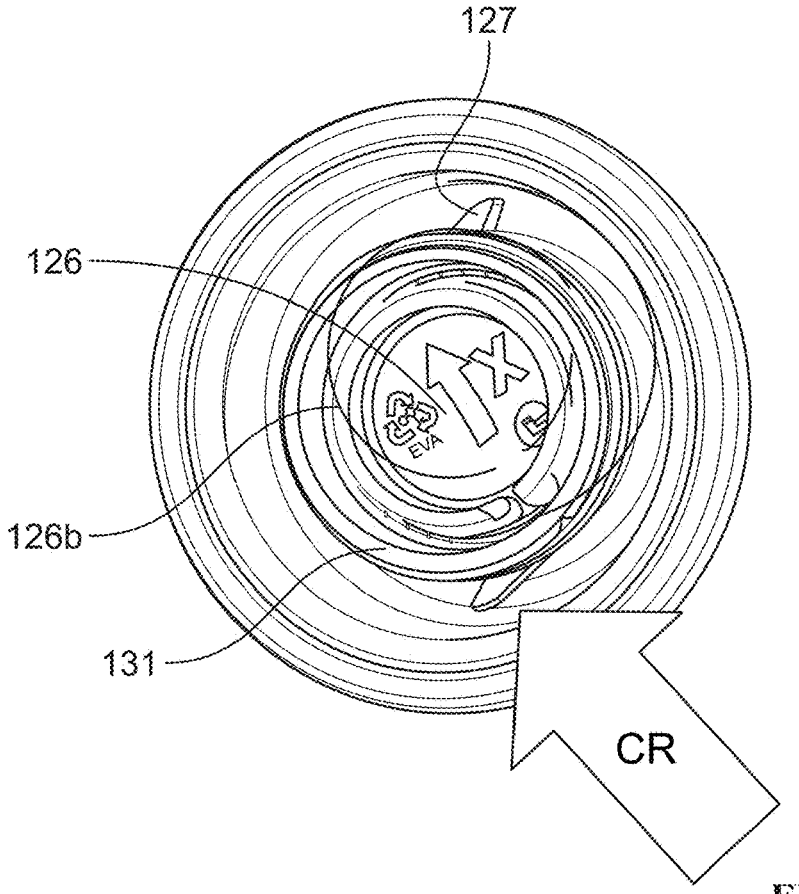
FIGS. 6A, 6B, and 6C are bottom perspective views, with FIG. 6A showing the spout in isolation, FIG. 6B showing the cover cap in isolation, and FIG. 6C showing the cover cap affixed to the spout, with a sectional cutaway to illustrate the positioning of the interlocking, child resistant tabs on the cover cap and facing of the spout. The arrows in each of these Figures highlights the child resistant tabs which, together with the natural resilience of the components on which the tabs are formed, enable squeeze and turn disengagement that allows for rotation of the cover cap relative to the spout.
Figure 6B:
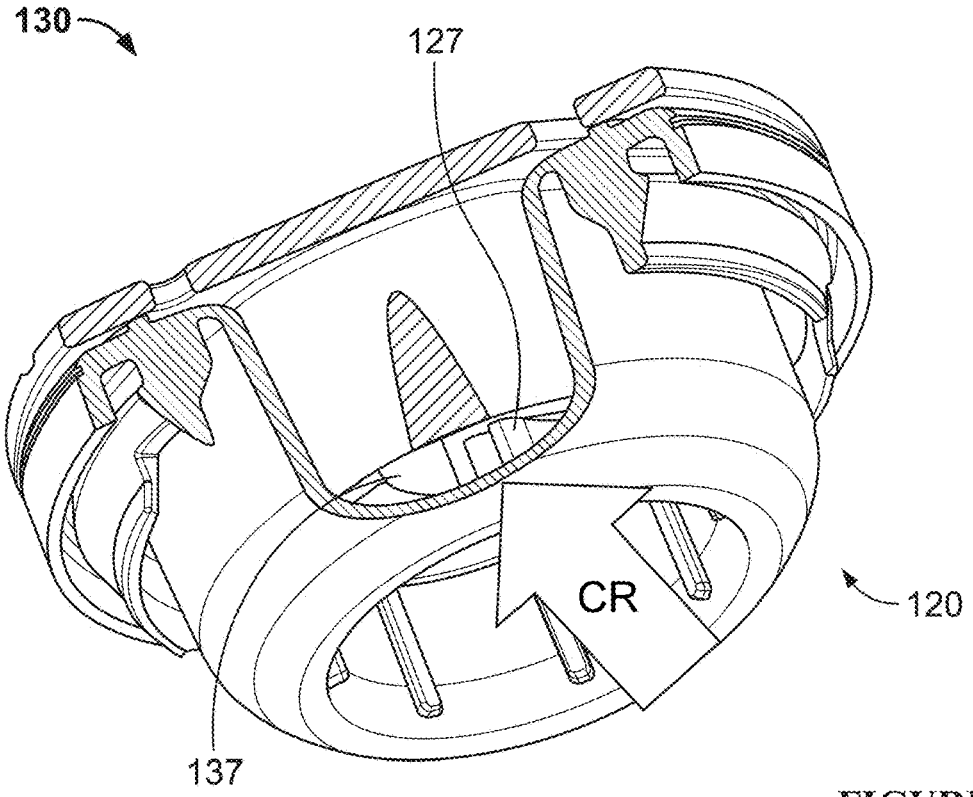
Figure 6C:
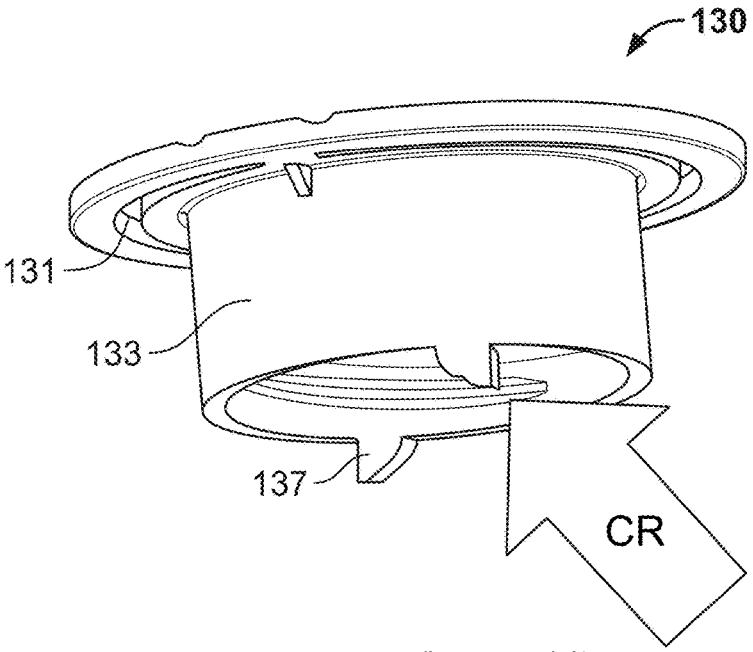

FIGS. 1 and 2 illustrate certain features of the closure 100 as it is attached to a container 10. Salient aspects of that container 10 are, in turn depicted in FIGS. 3A though 3D. Details of specific features in the closure 100 are shown in a variety of states in the remaining figures. The following description may refer to any of these Figures.

Container 10 is preferably blow-molded to produce the split line 11. However, other means of forming containers produce features/divisions that are common to split line 11, so that the design principles contemplated herein could be applied to those forms as well (e.g., injection molding, etc.).

Lugs 12 are formed on an outer surface of the neck proximate to attachment threads 13 (which engage cooperating threads 113, 213 on an inner facing of closures 100, 200, respectively speaking). Lugs 12 take the form of one or more ramps or ratchet-style tooth/teeth projecting radially outward relative to the neck of container 10. These ramps/teeth are sized to allow rotation of cooperating features on the closure 100 in one direction while inhibiting or prohibiting rotation in the opposing direction. In this manner, closure 100 can be tightened onto the container 10 while preventing its subsequent removal therefrom (at least by way of rotation). Positioning of the lugs 12 away from split line 11 ensures the lugs 12 will not smear upon ejection from the mold cavity.

Opening 14 is sized to receive closure 100 so as to selectively restrain fluid within the container 10 depending upon the positioning and engagement of the features of closure 100. Generally speaking, opening 14 should be circular and present with a flat top facing so as to allow for sealing with the closure 100. The diameter of opening 14 must be sized to allow portions of closure 100 to extend axially downward into the inner volume of container 10 at or below its neck.

Closure 100 possesses a cup-like shape, with a skirt 110 extending axially downward to engage the container 10. Threads 113 are formed along an inner facing of the skirt 110. Annular flange or top panel 111 protrudes radially inward at an approximately orthogonal relationship to the skirt 110. In turn, flange 111 defines an aperture which accommodates the other components of closure 100. Also, flange 111 serves to seal the closure 100 against the top facing of the container sidewalls defining opening 14.

Skirt 110 may include knurling, ribbing, or other grip-enhancing features. Additionally or alternatively, written indicia could be integrated or placed thereon. A reinforced, thicker annulus 112*a* may be provided at or proximate to the bottom, open end where the closure 100 is fitted over and coupled to the container 10.

Along the inner facing of skirt 110 within the thicker annulus 112, a plurality of lugs 112 project inwardly. Lugs 112 are formed to cooperate with corresponding lugs 12 on container 10. As noted above, once the closure 100 is screwed downward, lugs 12, 112 eventually come into alignment so as to prevent reverse motion that would result in the closure 100 being twisted upward/removed from the container 10. Notably, the relatively thicker annulus 112*a* also improves the hoop strength and allows the remaining portions of the skirt 110 to be formed from less material.

Collapsible spout 120 is attached or engaged by the lower facing ledge of flange 111. Because lugs 12, 112*a* prevent removal of closure 100 from container 10, it is possible to simply seat spout 120 between the flange 111 and the container 10 because axial movement will be restricted. Conversely, if spout 120 is formed as an integral part of closure 100, enhanced protection against leakage is ensured. Attachment means (as defined below) can be formed at the interfacing edges of the skirt 110/flange 111 and spout 120 to ensure these components remain in place.

Spout 120 includes an annular engagement flange 121, a first invertible section or cone 122 and a second section or cone 123 that can be nested within section 122. Threads 124 can be formed on section 123 to engage overcap 130. Also, proximate to flange 121, an axially-alinged sealing cone or plug seal 125 is formed coaxially to surround section 122, thereby improving alignment and engagement between the closure 100 and container 10.

A removable panel or tear out diaphragm 126 spans the opening formed in the spout 120, with that opening defined by the inner facings of section 123, with groove 126*a* defining the detachment point, with a grasping tab or ring 126*b* integrally formed on the top facing of panel 126 to facilitate detachment. Correspondingly, in closure 200, removable panel 226 can be formed across the opening in spout 220 and be removed by way of groove 226*a*.

Overcap 130 is frangibly connected to or formed separately from the skirt 110. A pull tab 131 attached to top panel 136 by way of element 132. When overcap 130 is coupled to the spout 120 (e.g., by way of cooperating threads 124, 134), a user can pull axially upward to displace section 123 from its nested position within section 122 to form an extend pouring spout that remains affixed to the container 10. Overcap 130 also has a cup-like shape, with a skirt 133 extending axially downward to coaxially receive section 123. Notably, skirt 133 may extend between a radial gap formed between sections 122 and 123.

The thickness and/or composition of sections 121, 122, 123 can be adjusted along the length or circumference of the cone shapes to facilitate deploying and retracting the spout, as well as to allow for the spout to be deployed at a specific angle. As shown, section 123 has a relatively thicker way section to accommodate the overcap 130 engagement and the child resistant features described below. Additionally or alternatively, ribs may be formed axially (as shown) or circumferentially to enhance the strength of the spout 120 and/or to facilitate its directional orientation. In view of the flexing action required to deploy and reinsert the spout 120 into its nested position, the use materials with sufficient strength and resilience is important.

While panel 126 is illustrated in FIG. 1, FIG. 2 depicts an aspect in which the panel 126 is not necessarily required. FIG. 2 is also representative an arrangement in which the panel 126 has been removed but the overcap 130 was replaced).

Certain child-resistant and tamper evident features are also contemplated. First, frangible connectors 135 can be integrally formed between the pull ring 131 and the flange 111 to verify whether the closure 100 has been initially opened. Additional or alternative frangible connectors could also be formed between the overcap 130 and flange 111 and/or the overcap 130 and spout 120.

Separately, one or more child resistant, cooperating tabs 127, 137 are formed along the circumference of spout 120 and overcap 130, respectively speaking. In one form, tab 127 is a ramped or ratcheted tooth or teeth projecting toward the overcap from section 122 and/or section 123. The corresponding tab 137 is formed on or proximate to the bottom of skirt 133 on overcap 130.

As shown, two separate pairs of tabs 127, 137 are provided. This arrangement allows the user to grasp the side of skirt 133 at orthogonal positions so as to squeeze and deform the skirt 133. This squeezing action causes the tabs 137 to move radially out of engagement relative to the tabs 127, thereby allowing for rotation and removal of the overcap 130. Arrow CR highlights the interface and position of these child-resistant features.

FIGS. 7 through 9C depict a separate embodiment of child-resistant closure 200 also including a selectively extendible spout 220. While specific features are shown in association with closure 200, it will be understood that certain aspects of closures 100, 200 can be freely applied to one another, particularly insofar as the final two digits of the reference numerals for components of closure 200 match those of corresponding closure 100 (e.g., skirt 110 is analogous to skirt 210, etc.).

Figure 7:
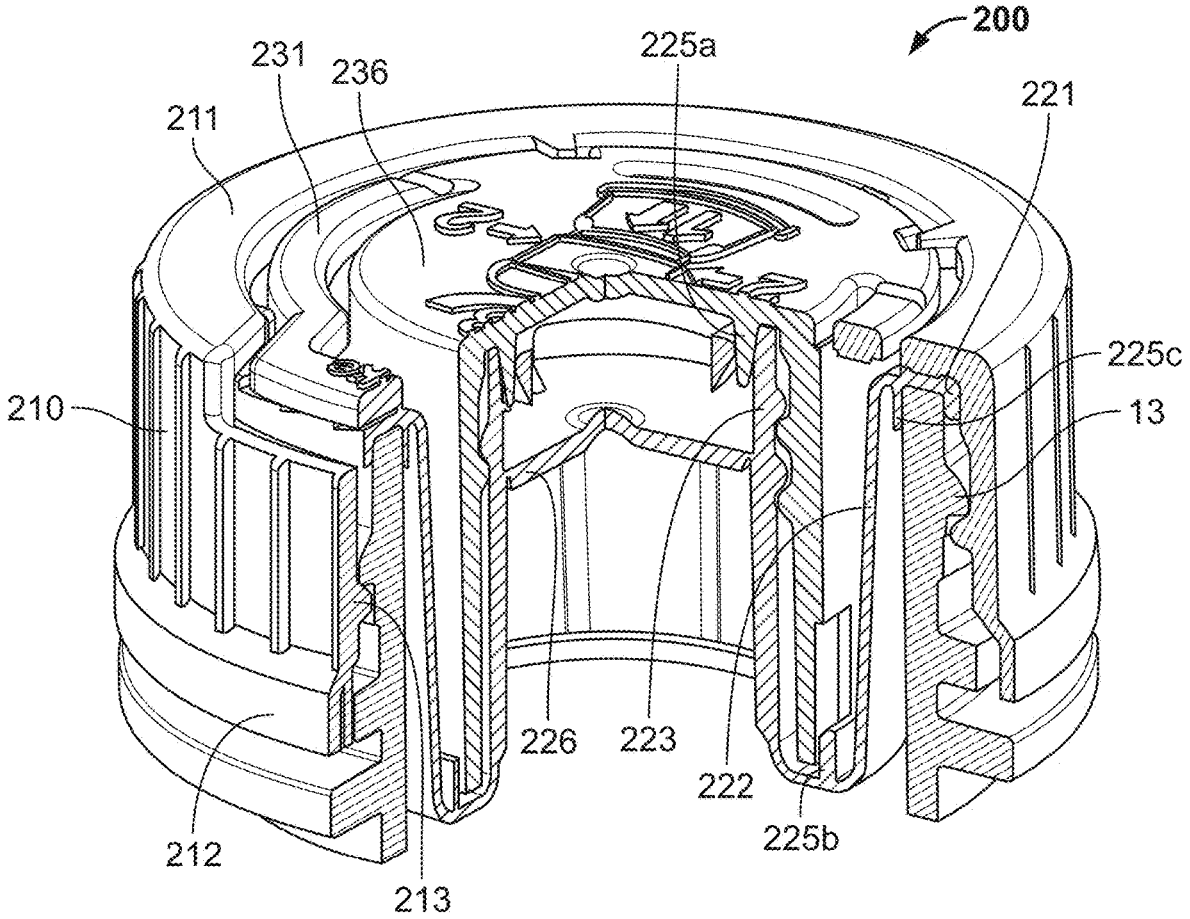
FIG. 7 is a top perspective view of second embodiment of a closure, including a cover cap, affixed to a container, but with a sectional cutaway along one quarter of the closure so as to highlight certain internal features and aspects of its attachment to and engagement with the container.
Figure 8A:
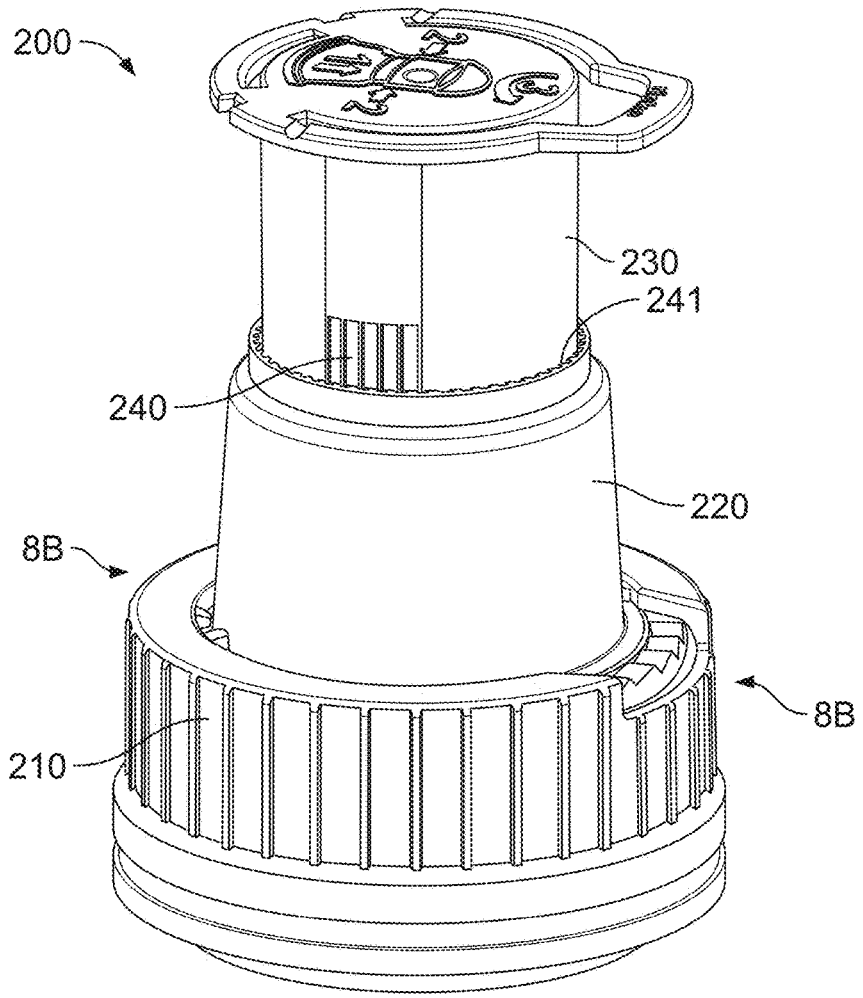
FIG. 8A is a top perspective view of the closure of FIG. 7, affixed to the container, but with the spout extended outward.
Figure 8C:
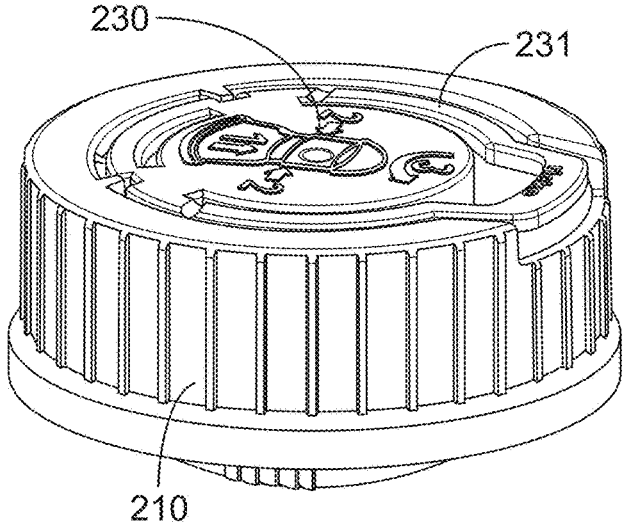
FIGS. 8C and 8D are isolated top perspective views of the overcap and the spout, both as contemplated by FIG. 7.
Figure 8D:
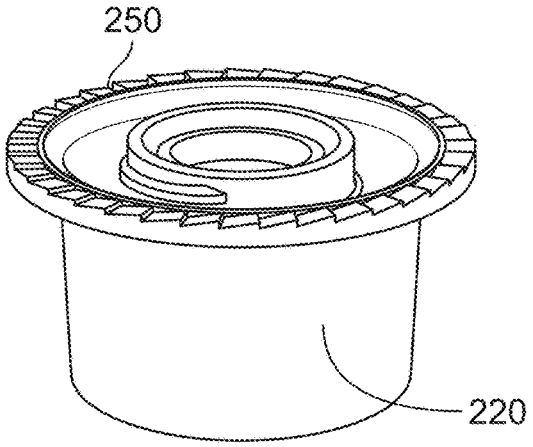
Figure 8B:
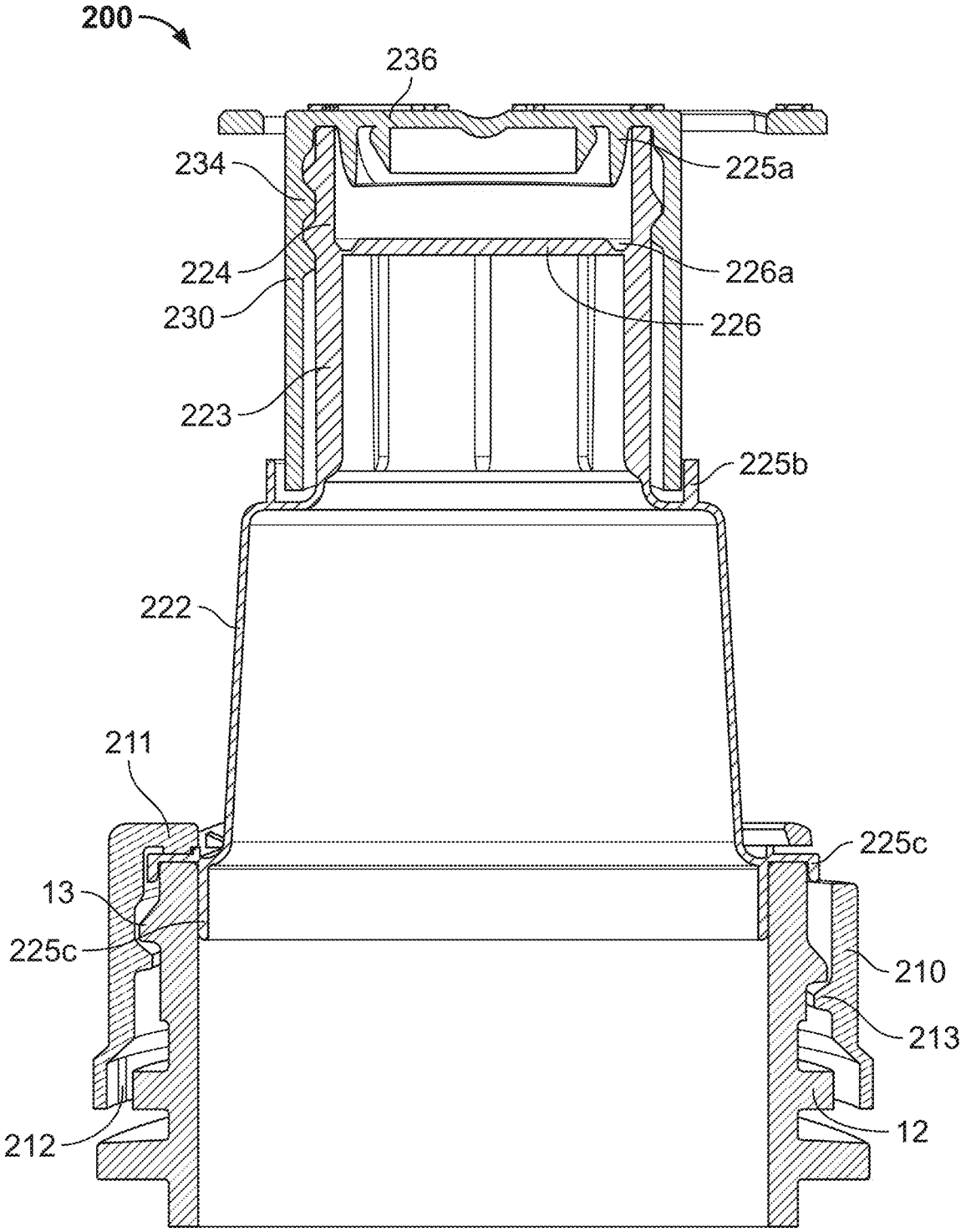
FIG. 8B is a cross sectional side plan view of the closure in FIG. 8A taken along line 8B-8B. Respectively speaking.
Figure 8E:
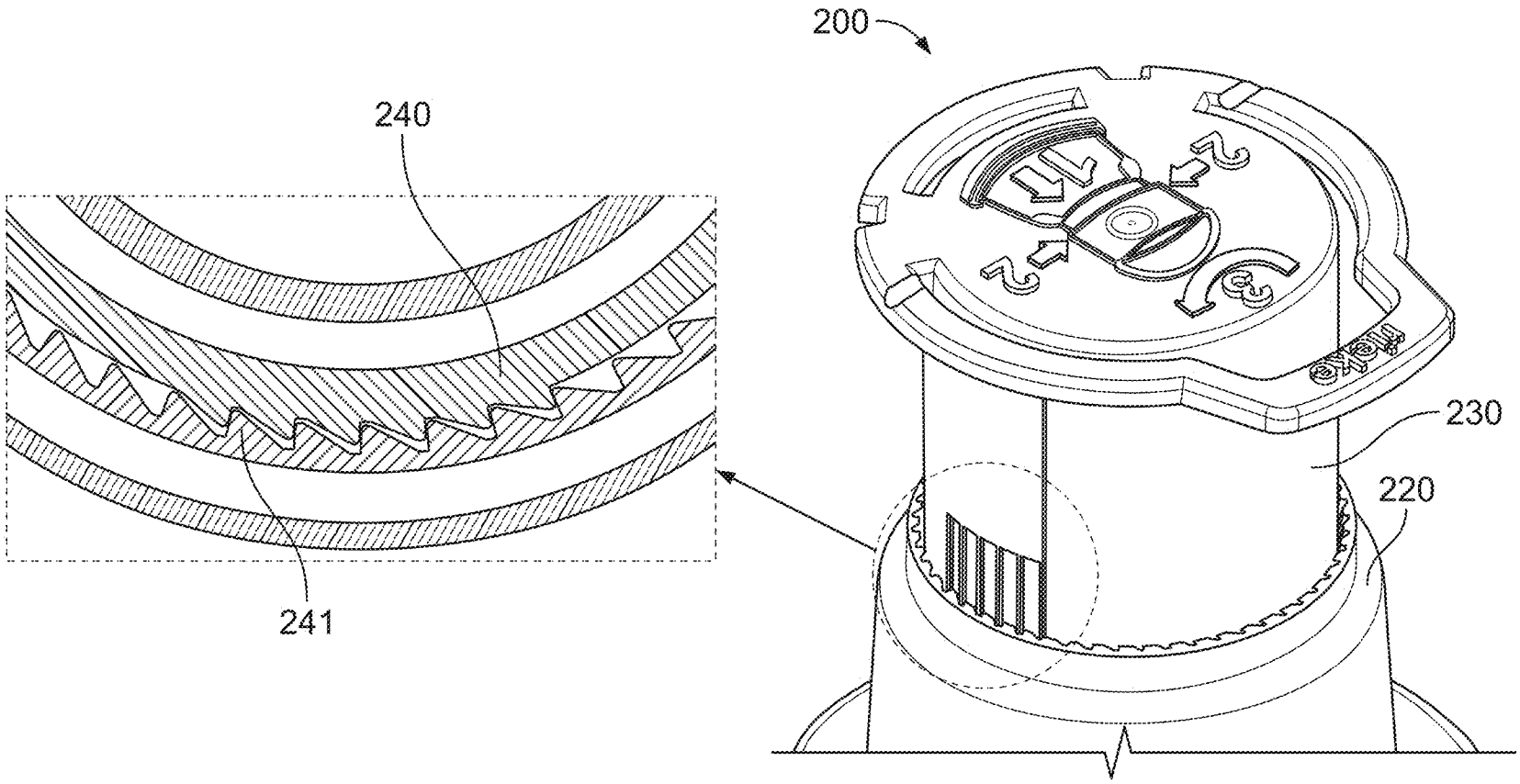
FIG. 8E is a sectional top perspective view, including an exploded top plan view of the callout, showing the ratchet formations on the overcap of FIG. 8C and the spout of FIG. 8D.

As above, closure 200 is affixed to container 10. Container 10 possesses all of the same features described above, details of which are shown in FIGS. 3A through 3D, including lugs 12, threads 13, and opening 14. Closure 200 generally comprises a cup shaped skirt 210 and overcap assembly 230, both of which conceal a spout 220 in its retracted position (as shown in FIG. 7).

One key feature of closure 200 is the formation of child resistant ratchets 240 on the cap 230. More specifically, ratchets 240 are positioned at the lower end of cap 230 so as to interface with corresponding features 241 formed on the spout 220. More specifically, features 241 can be positioned on or proximate to one of the invertible sections 222, 223 where the cap 230 interfaces therewith. These features 241 could also be provided on or along the interface between cap 230 and plug seal 225*b*. In operation, the resilient nature of the skirt portion 233 of cap 230 is sufficiently flexible to allow for squeezing at ratchets 240 to dislodge them from features 241, thereby allowing the cap 230 to be rotated along threads 224, 234 and disengaged from the spout 220. Preferably, features 241 are provided around all or substantially all (≥80%) of the inner facing circumference of the interfacing component (e.g., plug 225*b*), while ratchets 240 are provided on only a small arc (≤20%) of the corresponding circumference of skirt 233.

Notably, additional plug seals 225 may be provided on at least three different portions of spout 220 and/or cap 230. A first plug seal 225*a* is formed as a cylindrical extension from the top panel 236 of cap 230. Seal 225*a* abuts a terminal edge of spout 220 along second invertible cone section 223. Seals 225*b*, 225*c* may be formed on opposing facings on or proximate to first invertible cone section 222, with the former abutting the lower edge of cap 230 and the latter contacting one or both facing of the terminal edge of container 10 proximate to opening 14.

Another distinctive feature of closure 200 is the provision of ratchets or ramps 250 along the top facing of flange 221. Ramps 250 may cooperate with protrusions, lugs, or similar features on a bottom facing of flange 211 to secure the skirt 210 to the spout 220 and prevent relative movement and rotation when force is applied to unscrew cap 230 from spout 220. Additionally or alternatively, finger-like lugs 212 may extend radially inward at the bottom end of skirt 210 to engage cooperating features on the container 10 (e.g., lugs 12), so as to prevent unwanted rotation of closure 200 off of container 10.

Figure 9A:
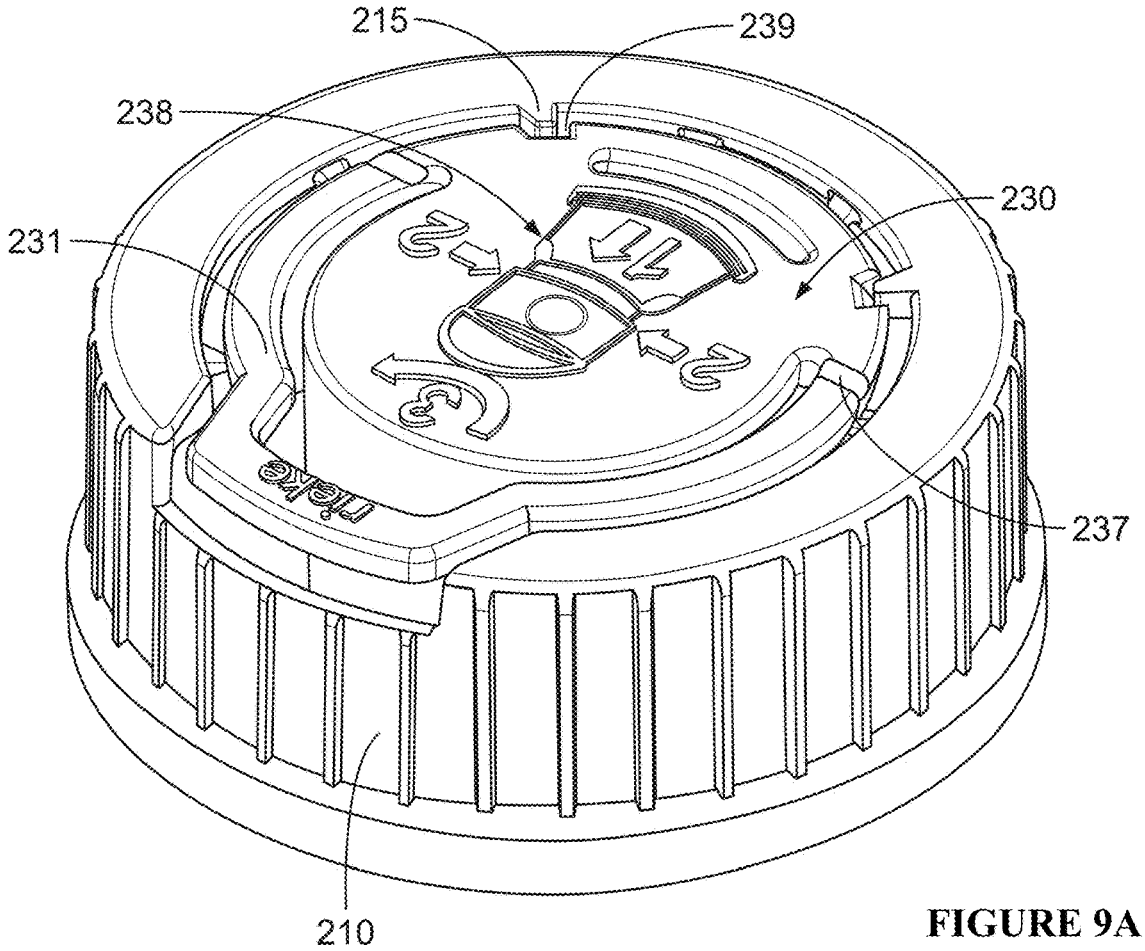
Figure 9B:
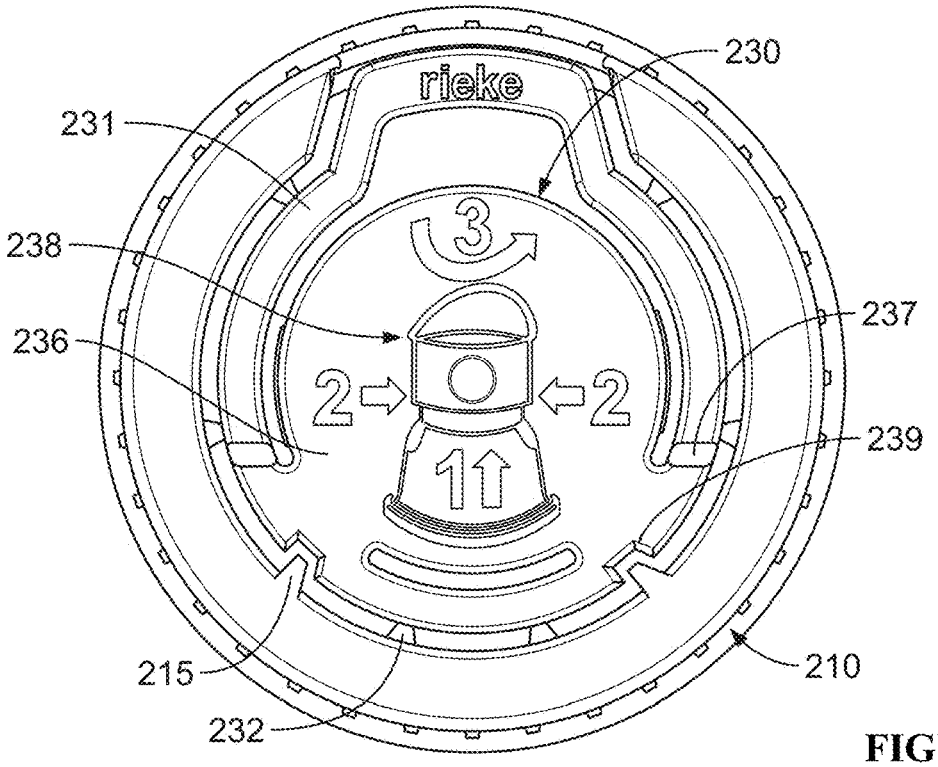
FIG. 9B is a top plan view of the same.
Figure 9C:
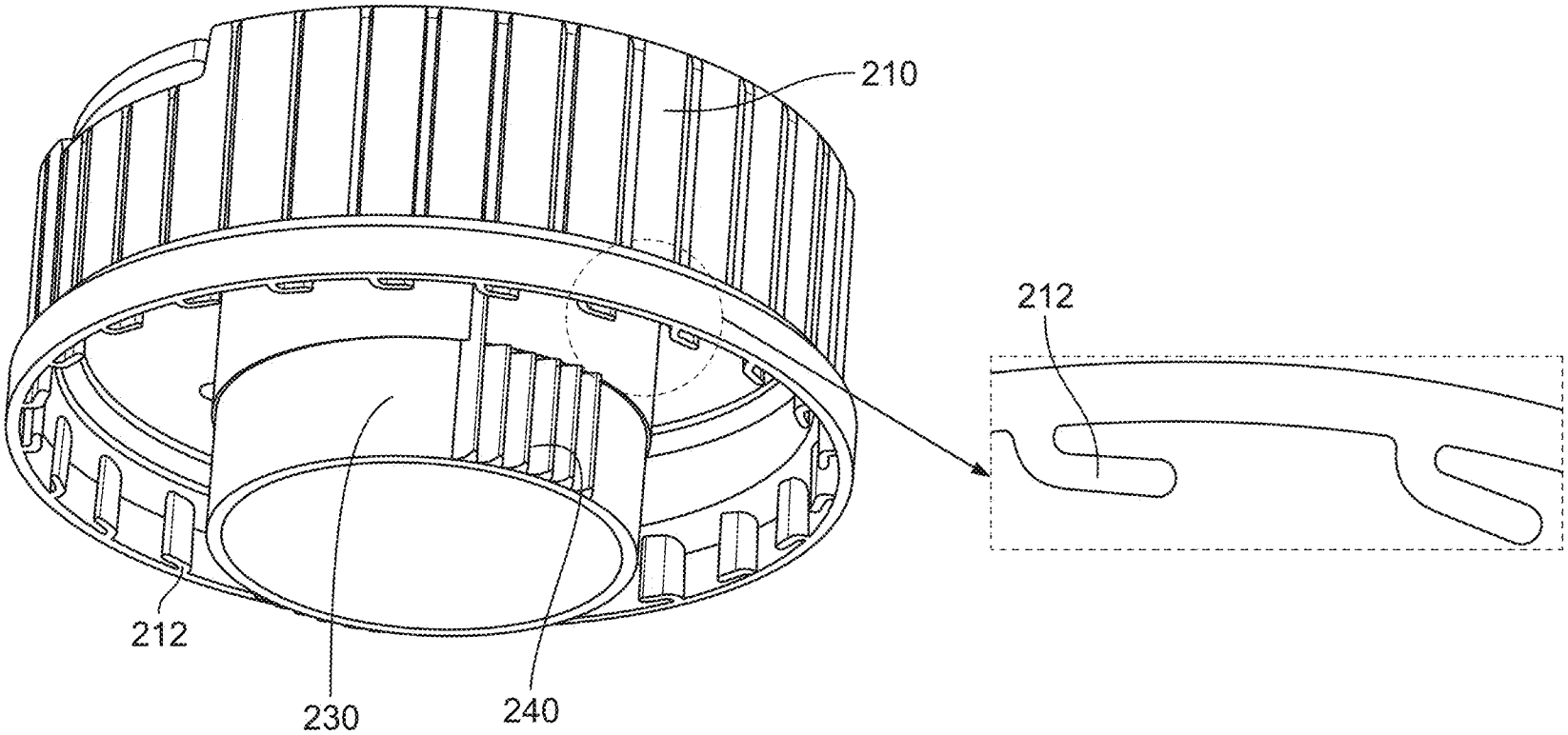
FIG. 9C is an isolated bottom perspective view of the closure from FIG. 9A showing the ratchets on the overcap, with an exploded bottom plan view based upon the callout in order to highlight the circumferential engagement lugs on the skirt.

As best seen in FIG. 9B, written indicia 238 can be integrally formed on the closure 200 (e.g., along the panel 236 of cap 230) to verify that pull ring 231 can be grasped by extending it upward, with grooves 237. Anti-rotational lugs 215 formed on the flange portion 211 can cooperate with indents 239 at the periphery of panel 236 to serve as guides during the process of extending the inverted portions 222, 223 of the spout 220. The second step indicated on the written indicia 238

A method of manufacturing a closure is also contemplated. Here, a thermoplastic or thermosetting resin is melted into a preform. A two piece cavity mold is provided and pressed into the preform so as to join the two pieces into a single mold, with compressed gas introduced to cause the preform to conform to the cavity mold and create an internal volume within the container formed by this process. A pair of child resistant lugs are formed in each of the two piece of the mold but positioned away from the split line formed that will be formed when the cavity mold is joined into a single mold. Separately, a closure is formed with cooperating lugs so as to create a container having a closure with a permanently attached screw top.

Still other methods of manufacture and forming of containers and closures, including closures having a collapsible spout, are contemplated. These methods are similar to the foregoing method and involve the provision of additional components within one or both of the cavity mold pieces.

A particular advantage to the structures and process noted above is that a flexible, child resistant spout can be provided in conjunction with a screw-top container. Further, the spout is integrated as part of the closure itself, thereby requiring minimal (if any) alterations or design features on the container.

Various aspects of the invention may include any combination of the following features:

an closure body having an radial flange defining a central aperture and having an annular skirt extending axially downward along an outer periphery of the radial flange;

a collapsible spout at least partially received within an inner facing of the annular skirt, the collapsible spout having a first invertible cone section with a peripheral container plug seal positioned proximate to the radial flange, a second cone section defining a dispensing aperture along an inner facing, and at least one overcap engagement protrusion positioned on an outer facing of the first and/or second cone section(s) and wherein the first and second cone sections are contiguous so that, when the spout is collapsed, the second cone section nests within the first cone section and, when the spout is extended, the second cone section extends axially above the first cone section; and an overcap attachable to the second cone section, the overcap having a top panel with an integral pull ring, a deformable skirt extending axially downward along an outer periphery of the top panel, and a child resistant protrusion positioned proximate to a terminal edge of the deformable skirt and wherein the child resistant protrusion engages the overcap engagement protrusion to selectively prevent removal of the overcap from the spout except when the deformable skirt is squeezed with sufficient force to disengage the child resistant and overcap protrusions.

wherein the child resistant protrusion is a pair of ramped lugs extending axially downward beyond a terminal edge of the deformable skirt wherein the child resistant protrusion is a plurality of ratchet teeth formed along an outer facing of the deformable skirt wherein the overcap engagement protrusion includes cooperating ratchet teeth positioned to face inward so as to engage the child resistant protrusion wherein the cooperating ratchet teeth are formed on substantially all of a periphery of the first and/or second cone section(s)

wherein an annular overcap plug seal, formed at a transition point between the first and second cone sections, abuts the terminal edge of the deformable skirt wherein the overcap engagement protrusion is formed on the annular overcap plug seal wherein the overcap engagement protrusion includes cooperating ratchet teeth formed on an inner facing of the annular overcap plug seal wherein anti-back off lugs are formed along an inner facing of the annular skirt wherein the anti-back off lugs engage cooperating lugs on an outer circumference of a container neck wherein anti-back off teeth are formed on a top facing of the radial flange wherein a removable panel initially seals the dispensing aperture wherein a plug seal is formed on an underside of the top panel so as to seal the dispensing aperture All components should be made of materials having sufficient flexibility and structural integrity, as well as a chemically inert nature. Certain grades of polypropylene and polyethylene may be particularly advantageous, although all grades of polymers capable of the molding techniques described herein could be used. Ultimately. the materials should be selected for workability, cost, and weight.

Certain structures which prevent or inhibit the relative rotation of components disclosed herein may be referred to as "anti-back off" These structures may include simple protrusions or lugs received within cooperating pockets or more nuanced structures that involve ratchet teeth where a gently sloping ramp presents on one facing so as to allow sliding movement over that surface, while a more sharply angled ramp presents on the opposite facing so as to inhibit or prevent sliding move over its surface. Any actual or perceived ambiguity can be resolved by referring to the drawings, as well as the context of the accompanying description.

References to "coupled" and/or "attached" in this disclosure are to be understood as encompassing any of the conventional means used in this field. This may take the form of snap- or force fitting of components, threaded connections, bead-and-groove arrangements, slot-and-flange assemblies, and the like. Adhesives and fasteners could also be used, although such components must be judiciously selected for durability, cost, and compatibility with the other disclosed components. In the same manner, "engagement" and/or "cooperating" may involve coupling or may involve a simple abutting relationship where elements are merely in contact or physical proximity with one another. These distinctions, as well as any implicit or explicit reference to coupling or attachment, should be considered in the context in which it is used. Any actual or perceived ambiguity can be resolved by referring to the drawings.

The foregoing claims highlight still other features contemplated in certain embodiments. As such, that section is also incorporated into this disclosure and further informs the drawings.

We claim:

1. A screw top closure attachable to a container neck having cooperating screw-on features, the closure comprising:

an closure body having an radial flange, defining a central aperture, and an annular skirt extending axially downward along an outer periphery of the radial flange;

a collapsible spout having a first invertible cone section with a peripheral container plug seal sealingly engaging the radial flange, a second cone section defining a dispensing aperture along an inner facing, and at least one overcap engagement protrusion positioned on an outer facing of the first and/or second cone section(s) and wherein the first and second cone sections are contiguous so that, when the spout is collapsed, the second cone section nests within the first cone section so as to be at least partially coaxially nested within the annular skirt and, when the spout is extended, the second cone section extends axially above the first cone section; and an overcap attachable to the second cone section, the overcap having a top panel with an integral pull ring, a deformable skirt extending axially downward along an outer periphery of the top panel, and a child resistant protrusion positioned proximate to a terminal edge of the deformable skirt and wherein the child resistant protrusion engages the overcap engagement protrusion to selectively prevent removal of the overcap from the spout except when the deformable skirt is squeezed with sufficient force to disengage the child resistant and overcap protrusions;

wherein the child resistant protrusion is a plurality of ratchet teeth formed along an outer facing of the deformable skirt; and wherein the overcap engagement protrusion includes cooperating ratchet teeth positioned to face inward so as to engage the child resistant protrusion.

2. The screw top closure of claim 1 wherein the child resistant protrusion is a pair of ramped lugs extending axially downward beyond a terminal edge of the deformable skirt.

3. The screw top closure of claim 1 wherein the cooperating ratchet teeth are formed on substantially all of a periphery of the first and/or second cone section(s).

4. A screw top closure attachable to a container neck having cooperating screw-on features, the closure comprising:

an closure body having an radial flange, defining a central aperture, and an annular skirt extending axially downward along an outer periphery of the radial flange;

a collapsible spout having a first invertible cone section with a peripheral container plug seal sealingly engaging the radial flange, a second cone section defining a dispensing aperture along an inner facing, and at least one overcap engagement protrusion positioned on an outer facing of the first and/or second cone section(s) and wherein the first and second cone sections are contiguous so that, when the spout is collapsed, the second cone section nests within the first cone section so as to be at least partially coaxially nested within the annular skirt and, when the spout is extended, the second cone section extends axially above the first cone section; and an overcap attachable to the second cone section, the overcap having a top panel with an integral pull ring, a deformable skirt extending axially downward along an outer periphery of the top panel, and a child resistant protrusion positioned proximate to a terminal edge of the deformable skirt and wherein the child resistant protrusion engages the overcap engagement protrusion to selectively prevent removal of the overcap from the spout except when the deformable skirt is squeezed with sufficient force to disengage the child resistant and overcap protrusions;

wherein the child resistant protrusion is a plurality of ratchet teeth formed along an outer facing of the deformable skirt; and wherein an annular overcap plug seal, formed at a transition point between the first and second cone sections, abuts the terminal edge of the deformable skirt.

5. The screw top closure of claim 4 wherein the overcap engagement protrusion is formed on the annular overcap plug seal.

6. The screw top closure of claim 5 wherein the overcap engagement protrusion includes cooperating ratchet teeth formed on an inner facing of the annular overcap plug seal.

7. The screw top closure of claim 1 wherein anti-back off lugs are formed along an inner facing of the annular skirt.

8. The screw top closure of claim 7 wherein the anti-back off lugs engage cooperating lugs on an outer circumference of a container neck.

9. The screw top closure of claim 1 wherein anti-back off teeth are formed on a top facing of the radial flange.

10. The screw top closure of claim 1 wherein a removable panel initially seals the dispensing aperture.

11. The screw top closure of claim 1 wherein a plug seal is formed on an underside of the top panel so as to seal the dispensing aperture.

12. The screw top closure of claim 1 further comprising a container having one or more lugs proximate to a neck which engage an inner facing of the annular skirt to prevent removal of the screw top closure after said screw top closure has been threadingly coupled to the neck.

13. The screw top closure of claim 4 wherein anti-back off lugs are formed along an inner facing of the annular skirt.

14. The screw top closure of claim 13 wherein the anti-back off lugs engage cooperating lugs on an outer circumference of a container neck.

15. The screw top closure of claim 4 wherein anti-back off teeth are formed on a top facing of the radial flange.

16. The screw top closure of claim 4 wherein a removable panel initially seals the dispensing aperture.

17. The screw top closure of claim 4 further comprising a container having one or more lugs proximate to a neck which engage an inner facing of the annular skirt to prevent removal of the screw top closure after said screw top closure has been threadingly coupled to the neck.

* * * * *